US006227019B1

(12) United States Patent
Chhatwal

(10) Patent No.: US 6,227,019 B1
(45) Date of Patent: May 8, 2001

(54) DUAL KEY PORT ACCESSIBLE INTELLIGENT GATE LOCK

(75) Inventor: Kn Singh Chhatwal, Melbourne, FL (US)

(73) Assignee: Intellikey Corporation, Melbourne, FL (US)

( * ) Notice: Subject to any disclaimer, the term of this patent is extended or adjusted under 35 U.S.C. 154(b) by 0 days.

(21) Appl. No.: 09/303,467

(22) Filed: Apr. 30, 1999

(51) Int. Cl.[7] ..... E05B 65/06

(52) U.S. Cl. ..... 70/93; 70/56; 70/278.1; 70/134; 292/341.17; 292/144

(58) Field of Search ..... 70/93, 101, 278.1–278.3, 70/278.7, 55, 56, 134; 292/144, 201, 341.15–341.17

(56) References Cited

U.S. PATENT DOCUMENTS

| | | | | |
|---|---|---|---|---|
| 416,433 | * | 12/1889 | Wilson | 70/56 |
| 1,136,582 | * | 4/1915 | Birdsong | 70/56 |
| 1,220,941 | * | 3/1917 | Bowers | 70/56 |
| 3,657,908 | * | 4/1972 | Schwartz et al. | 70/93 |
| 3,990,182 | * | 11/1976 | Linder | 70/56 X |
| 4,240,278 | * | 12/1980 | Linder | 70/56 |
| 4,406,486 | * | 9/1983 | White | 292/144 |
| 4,472,143 | * | 9/1984 | Bennett et al. | 70/93 X |
| 4,616,863 | * | 10/1986 | Bryant | 292/302 |
| 4,815,305 | * | 3/1989 | Smith | 70/93 |
| 5,016,453 | * | 5/1991 | Bonnice et al. | 70/93 |
| 5,337,588 | * | 8/1994 | Chhatwal | 70/278 |
| 5,492,382 | * | 2/1996 | McBride et al. | 292/341.17 |
| 5,507,162 | * | 4/1996 | Chhatwal | 70/278 |
| 5,625,349 | * | 4/1997 | Disbrow et al. | 70/278 X |
| 5,758,529 | * | 6/1998 | Chhatwal | 70/423 |
| 5,765,411 | * | 6/1998 | Rowan | 70/134 |
| 5,791,179 | * | 8/1998 | Brask | 70/278.1 |
| 5,819,563 | * | 10/1998 | Bianco | 70/278 |
| 5,850,753 | * | 12/1998 | Varma | 70/278.7 |
| 6,035,676 | * | 3/2000 | Hudspeth | 70/278.1 |

FOREIGN PATENT DOCUMENTS

| | | | | |
|---|---|---|---|---|
| 709801 | * | 8/1941 | (DE) | 70/93 |
| 299978 | * | 12/1989 | (JP) | 70/93 |
| 299979 | * | 12/1989 | (JP) | 70/93 |

* cited by examiner

*Primary Examiner*—Suzanne Dino Barrett
(74) *Attorney, Agent, or Firm*—Allen, Dyer Doppelt Milbrath & Gilchrist, P.A.

(57) ABSTRACT

A stand alone, electronic gate lock is integrally mountable with a barrier, such as a perimeter fence of an airport. The gate lock is configured to be locked and unlocked by an electronic key from key access ports on each of interior and exterior sides of the barrier. An electronic controller of the gate lock stores data associated with each attempted electronic key access of the gate lock, so that a history of access to the gate can be tracked. This enables every access to the gate lock to be tracked, thereby increasing the likelihood that the gate will be maintained in its locked condition at all times other than when opened for authorized access.

20 Claims, 3 Drawing Sheets

DUAL KEY PORT ACCESSIBLE INTELLIGENT GATE LOCK

FIELD OF THE INVENTION

The present invention relates in general to access control systems, and is particularly directed to a stand alone, electronic gate lock that is integrally mountable with a barrier, such as a moveable gate, or a fixed structural element (e.g., fence post), of a security boundary, such as the perimeter fence of an airport. The gate lock is configured to be locked and unlocked by an electronic key from respective key access ports on each of interior and exterior sides of the barrier. An electronic controller of the gate lock stores data associated with each attempted electronic key access of the gate lock, so that a history of access to the gate can be tracked.

BACKGROUND OF THE INVENTION

Although the growing awareness of the need for improved reliability security measures in essentially every type of facility has stimulated the introduction of a variety of new security access products, many installations continue to rely on standard hardware components, such as mechanical padlocks and the like, for locking barrier access closures, such as gates and doors. Unfortunately, it is a well established statistic that individuals who are permitted access to these components sometimes fail to properly lock the barrier access closure. Not only does this result in a breach of security, but in many instances there is no way to determine who is responsible for the failure, in order that the problem can be corrected. This problem is particularly acute at locations where a breach of security has the potential for significant devastating consequences to the public.

This concern has resulted in government agencies which oversee such installations issuing stricter security directives. In the case of an airport as a non-limiting example, the Federal Aviation Administration (FAA) has issued upgraded regulations regarding access to areas well outside of a public terminal area, especially along the airport's a perimeter fence barrier. Now even though airports have begun substantial upgrades of existing security access mechanisms, including improved lock hardware, installing and maintaining electrical power and communication links that would allow centralized monitoring and control of remote (perimeter runway fence) gate access points, yet still allow brute force gate breach by emergency vehicles, such as fire/crash trucks, so as to fully comply with FAA safety and security directives is currently prohibitively expensive.

SUMMARY OF THE INVENTION

In accordance with the present invention, these problems are successfully addressed by a stand alone, electronic gate lock architecture that is readily installable at a gate closure region of a barrier, such as a moveable or fixed component (e.g., a swing gate or a post element) of a security boundary, for example an airport security fence. The gate lock includes a mounting plate that is affixable to an interior side of the barrier that is adjacent to a closure structure, such as a frame of a swingable gate. The gate lock mounting plate is sized to retain a dual electronic lock mechanism and a battery-operated electronic lock controller. The lock's control processor not only operates the dual lock mechanism, but stores a variety of history data associated with each electronic key access, including date and time of access, and the location of the lock. As a result, all user access to the gate lock can be tracked, thereby increasing the likelihood that the gate will be maintained in its locked condition at all times other than when opened for authorized access.

To provide gate lock/unlock capability at both the interior side and the exterior side of the barrier, the dual electronic lock mechanism has a pair of mutually aligned, electronically actuated lock mechanisms mounted to opposite sidewalls of a common deadbolt casing, that is secured to the mounting plate. Each lock has an exterior pivotable cover, that protects the lock against weather and the environment. A generally L-shaped, gate lock bracket, having a fence for engaging a latching medium, such as a closed loop of fire code-compliant chain, is affixed to the deadbolt casing. The fence has a notch sized to receive the deadbolt, when the deadbolt is rotated by the operation of either of the two electronically actuated lock mechanisms. The fence is sized and configured to accommodate and permit some degree of play of different sized chain loops. This compensates for sagging and imperfect alignment between the gate and the fence post, that is typical of swinging gates. A gate lock shroud is attached to the deadbolt casing as a protective awning for that portion of the deadbolt casing from which the deadbolt projects.

When both electronically actuated locks are locked, the deadbolt extends from the casing into a gate-locking spatial configuration with the notch of the fence, so that a secure closure is formed around the chain loop, maintaining the swingable gate in a closed position with the barrier. When either locking mechanism is unlocked, the deadbolt is retracted out of the fence notch, to allow the chain loop to be lifted off and away from the fence, thereby freeing the swingable gate from its chain engagement with the fence post.

DETAILED DESCRIPTION

The architecture of an electronic dual access port gate lock in accordance with a preferred embodiment of the present invention will now be described with reference to FIGS. 1–17. As shown in the respective front and rear view of FIGS. 1 and 2, and the side view of FIG. 3, the gate lock architecture includes a gate lock mounting plate 10 (shown in detail in FIGS. 4 and 5), made of a rigid, durable material, such as quarter inch stainless steel, that is sized to retain each of the hardware components of the electronic gate lock architecture of the invention.

Figure 1:
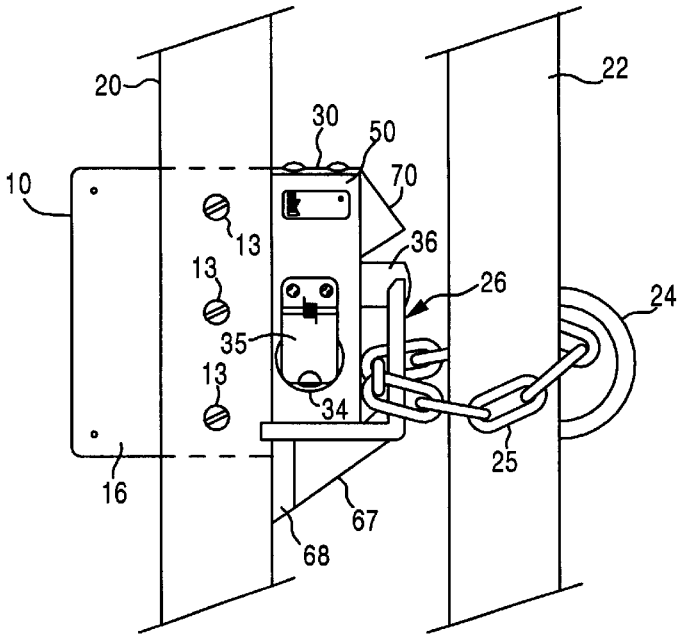
FIG. 1 is a diagrammatic front view of the electronic gate lock of the present invention.

The FIG. 1 front view of the gate lock is shown from the exterior side of a gate barrier 20. As pointed out previously, the gate barrier may comprise a fixed structure, such as, but not limited to a fence post, or a moveable member, such as, but not limited to a moveable (e.g., swingable) gate element of a security boundary, for example, a perimeter chain link security fence of an airport. For purposes, of the present description, the gate barrier 20 will described in the context of a fixed structure, in particular a fence post of a chain link security fence. For this example, the gate lock mounting plate 10 is affixed to an interior side of the fence post 20. Also shown adjacent to the fence post 20 is the frame 22 of a swingable gate 24, and a length of closed loop of (fire code compliant, crash truck-break away) chain 25 wrapped around the gate frame 22 and a generally 'L'-shaped gate lock bracket 26 of the gate lock, to be described.

Figure 4:
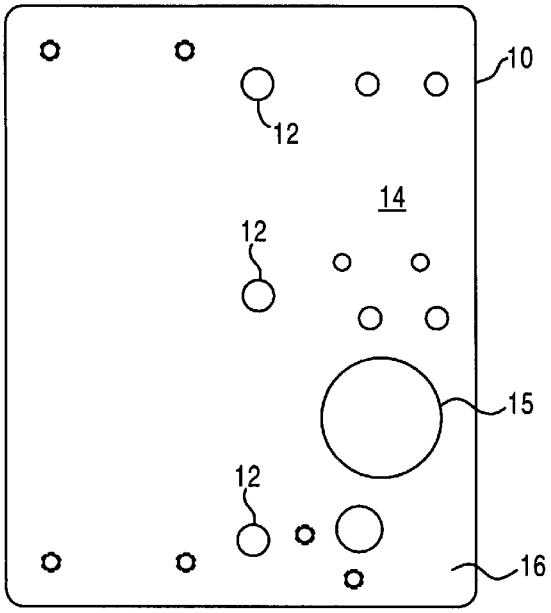
FIGS. 4 and 5 are plan and edge views of a gate lock mounting plate.
Figure 5:
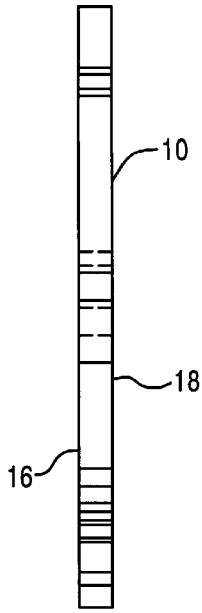
Figure 9:
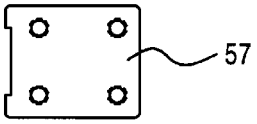
FIGS. 6–10 show sidewall and endwall views of a generally rectilinear, hollow deadbolt casing.
Figure 10:
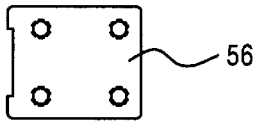
Figure 6:
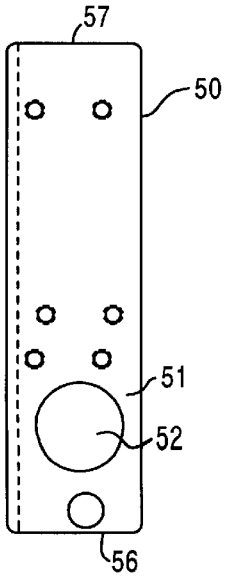
Figure 7:
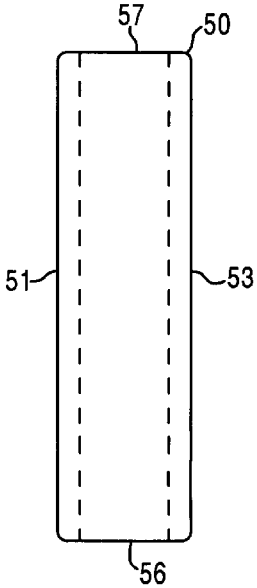
Figure 8:
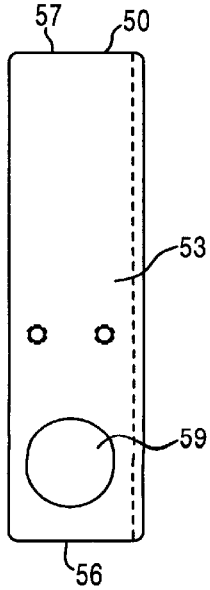
Figure 13:
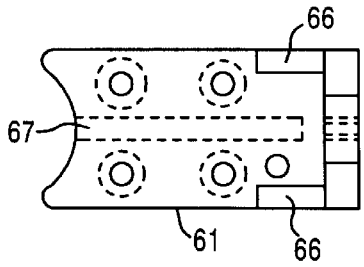
FIGS. 11–14 are respective side, end, top and bottom views of a gate lock bracket.
Figure 11:
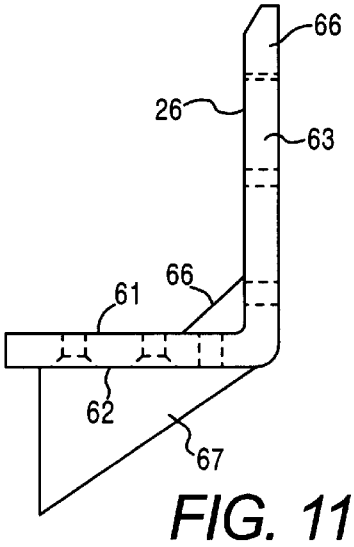
Figure 12:
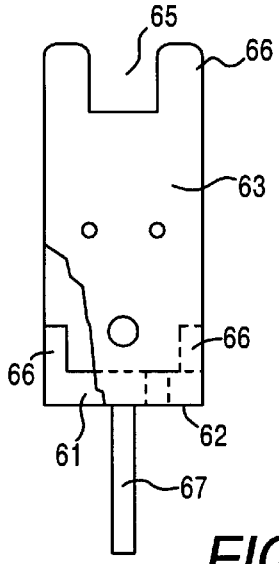
Figure 14:
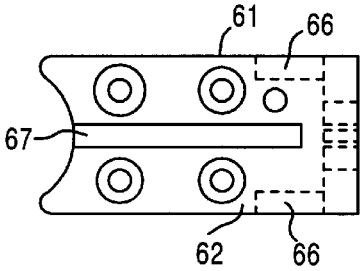

As shown in FIGS. 4 and 5, the gate lock mounting plate 10 may include a plurality of spaced apart holes 12 sized to receive bolts or the like, that pass through associated holes 13 in and affix the mounting plate 10 to the gate barrier post 20. Once so affixed, the gate lock mounting plate 10 may be further spot welded to the barrier post 20 to increase lock-barrier integrity. The gate lock mounting plate 10 is sized and the fence post-mounting holes 12 are located, so as leave a sufficient surface region 14 on the front or exterior-facing side 16 of the mounting plate 10 for a dual electronic lock mechanism 30, and to also provide a surface region 21 on a rear or interior-facing side 18 of the mounting plate for accommodating an electronic lock controller circuit 40.

The electronic lock controller 40 for the dual electronic lock mechanism includes a battery pack and supervisory microprocessor circuitry for controlling the operation of the two electronic locks of the electronic lock mechanism 30. The controller is retained within a weather-proof housing 42 mounted to the surface region 21 of the rear side 18 of the plate 10. Electrical connections between the controller 40 and the dual electronic lock mechanism is provided by way of a cable 45. In accordance with a non-limiting but preferred embodiment of the invention, the electronic lock controller 40 may be of the type employed in the electronic lock and key system described in the U.S. Pat. No. 5,625,349 to Disbrow et al, entitled: "Electronic Lock and Key System," assigned to the assignee of the present application and the disclosure of which is herein incorporated.

As described therein, the control software executed by the lock's control processor is operative to store a variety of data associated with each electronic key access, including date of use of an electronic key engaging a respective lock, time of use of an electronic key engaging the lock, and the location of the lock. Since such key entry data storage allows the history of access to the gate lock to be tracked, it makes each user accountable, and substantially increases the likelihood that an unlocked gate will be properly relocked, thereby improving security. This feature, in conjunction with the fact that the electronic gate lock of the invention is battery powered, obviates the need to install and maintain electrical power and communication links to a centralized monitoring and control site.

To provide gate lock/unlock capability at both the interior side and the exterior side of the barrier, the dual electronic lock mechanism 30 includes a pair of mutually aligned, electronically actuated lock mechanisms 32 and 34, that are physically arranged so that they may operate a common deadbolt 36. Respective keyways for these two aligned lock mechanisms are ported to the interior and exterior sides of the gate lock, so that the gate lock may be locked and unlocked by an electronic key from either side of the barrier.

In accordance with a non-limiting but preferred embodiment of the present invention, each of the electronically actuated lock mechanisms 32 and 34 may comprise a generally cylindrically configured electronic lock of the type described in my U.S. Pat. No. 5,337,588, entitled: "Electronic Lock and Key System," assigned to the assignee of the present application and the disclosure of which is herein incorporated. Alternatively, each lock may comprise a Eurocylinder-shaped electronic lock, of the type described in my U.S. Pat. No. 5,507,162, entitled: "Eurocylinder-type Assembly for Electronic Lock and Key System," also assigned to the assignee of the present application and the disclosure of which is herein incorporated.

Pivotable external covers 33 and 35 respectively protect the locking mechanisms 32 and 34 against the introduction of moisture and foreign matter due to weather and the environment. As a non-limiting but preferred example, such protective covers may be of the type described in my U.S. Pat. No. 5,758,529, entitled: "Protective Cover for Electronic Lock," assigned to the assignee of the present application and the disclosure of which is herein incorporated.

In order for each of the electronically actuated lock mechanisms 32 and 34 to actuate the same dead bolt, they may be mounted to opposite walls of a generally rectilinear, hollow stainless steel deadbolt casing 50 (sidewall and endwall views of which are shown in detail in FIGS. 6–10) in which the deadbolt 36 is rotationally retained. As a non-limiting example, the deadbolt and casing therefor may correspond to the hardware configuration of a Deadlock Series MS1850S lock, manufactured by Adams Rite Manufacturing Co., City of Industry, Calif., 91749. The deadbolt casing 50 is mounted to the surface region 14 on the front or exterior-facing side 16 of the gate lock mounting plate 10. In order that each of the two lock mechanisms 32 and 34 may operate the deadbolt 36, mutually opposing sidewalls 51 and 53 of the deadbolt casing 50 have respective generally cylindrical bores 52 and 54, that are aligned with a corresponding cylindrical bore 15 in mounting plate 10, and are sized to accommodate the generally cylindrically configured electronic locks 32 and 34.

The generally L-shaped, gate lock bracket 26 is shown in detail in FIGS. 11–14, and may be comprised of half-inch stainless steel plate. The gate lock bracket 26 has a generally flat base portion 61, which is mounted by way of suitable fasteners, such as screws or the like, and holes provided for the purpose, to the bottom endwall 56 of the deadbolt casing 50. A fence 63 for engaging a gate latching medium, such as the chain loop 25 shown in FIG. 1, extends at a generally right angle from the base portion 61.

The fence 63 has a notch or groove 65 in an end portion 66 thereof. The notch 65 is sized to receive the deadbolt 36, when the deadbolt is rotated by either of respective cams (not shown) that are attached to the solenoid output shafts (not shown) of either of the two electronically actuated lock mechanisms 32 and 34. The height of the bracket fence 63 is such that there is sufficient separation between the flat base portion 61 and the notch 65 to accommodate different sized chain loops 25 and to permit some degree of play of a captured latching medium (chain). This serves to compensate for sagging, and imperfect alignment between the gate and the fence post, that is typical of swinging gates. For strength and rigidity, a pair of gussets 66 adjoin the flat base portion 61 and the fence 63, and an exterior web region 67 projects beneath the bottom surface 62 of the flat base portion, and is welded at a weld joint 68 to fence post 20.

Figure 17:
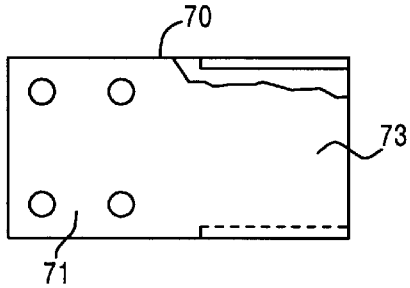
FIGS. 15–17 are respective side, end, and top views of a gate lock shroud.
Figure 15:
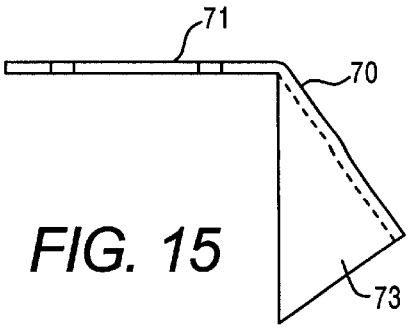
Figure 16:
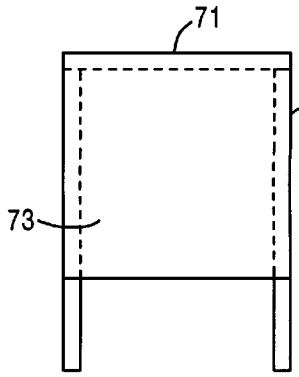

A gate lock shroud 70, shown in detail in FIGS. 15–17, and made of a rigid sturdy material, such as eighth inch stainless steel, has a first attachment bracket portion 71 that is attached by way of suitable fasteners, such as screws or the like, and holes provided for the purpose, to the top endwall 57 of the deadbolt casing 50. An awning 73 extends downwardly at an acute angle from the attachment bracket portion 71 of the shroud, and serves to protect that portion of the deadbolt casing 50 from which the deadbolt 36 projects.

Figure 2:
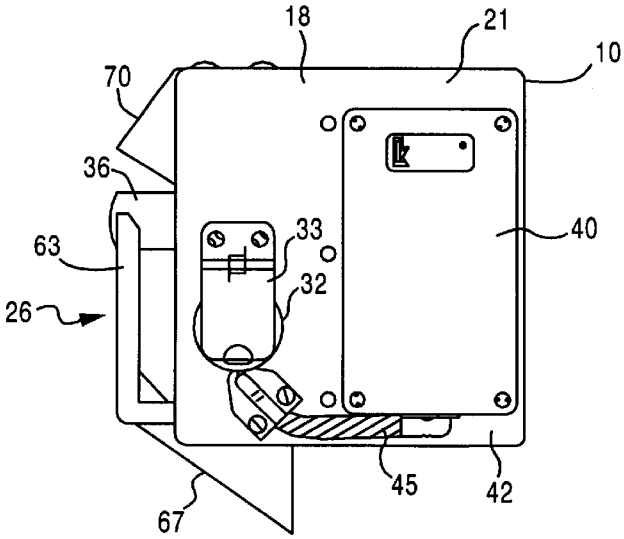
FIG. 2 is a diagrammatic rear view of the electronic gate lock of FIG. 1.
Figure 3:
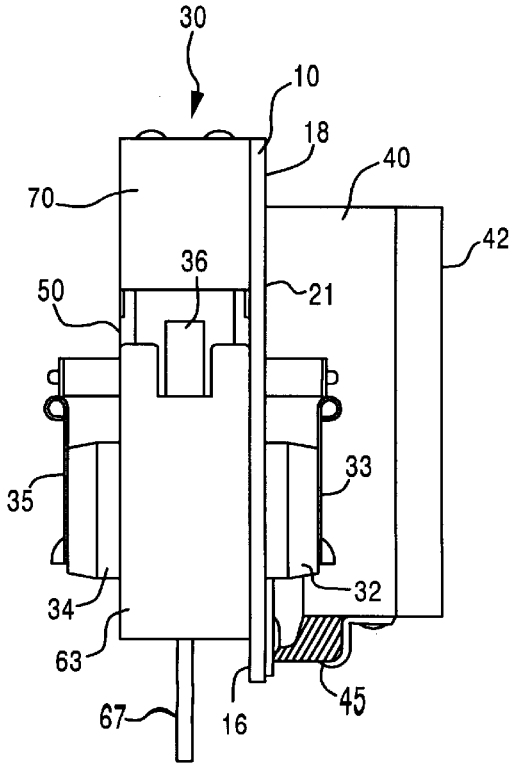
FIG. 3 is a diagrammatic end view of the electronic gate lock of FIG. 1.

When both electronically actuated locks are locked, the deadbolt 36 is extended into a 'gate locking' spatial position in the notch 65 of the fence 63, as shown in FIGS. 1–3, so that a secure closure is formed around the chain loop 25, to maintain the swingable gate 24 in a closed position with the barrier (fence post) 20. On the other hand, when either locking mechanism 32 or 34 is unlocked, the deadbolt 36 is retracted out of the fence notch 65, thereby allowing the chain loop 25 to be lifted off and away from the fence 63, freeing the swingable gate 24 from its chain engagement with the fence post 20.

As will be appreciated from the foregoing description, the above-referenced shortcomings of conventional gate locks used for securely closing and locking controlled barrier access points, such as swingable gates and the like, are successfully remedied by the electronic gate lock architecture of the present invention, which is installable at a respective barrier access point as a stand alone structure, and is configured to allow the lock to be locked and unlocked by an electronic key from respective ports on either side of the barrier. Because the gate lock controller stores a history of each electronic key access, every access to the gate lock can be tracked, thereby increasing the likelihood that the gate will be maintained in its locked condition at all times other than when opened for authorized access.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed is:

1. For use with a barrier having one or more gates through which access through the barrier is afforded, a method of controllably enabling access through a gate comprising the steps of:

(a) mounting, at a gated access region of said barrier at which said gate is installed, an electronically operated gate locking mechanism that engages a gate latching medium for securing said gate in a closed position with said barrier, and is configured to be locked and unlocked by an electronic key at each of first and second sides of said barrier; and (b) storing within said electronically operated gate locking mechanism information representative of a history of electronic key operation thereof at each of said first and second sides of said barrier.

2. A method according to claim 1, wherein said electronically operated gate locking mechanism is stand-alone locking mechanism having a self-contained electrical power source.

3. A method according to claim 1, wherein said barrier comprises a fence having a fence post at a gate region thereof, and step (a) comprises integrally mounting said electronically operated gate locking mechanism with said fence post.

4. A method according to claim 1, wherein said electronically operated gate locking mechanism includes:

a locking member moveable between a first, gate locking position that maintains said gate coupled with said gate latching medium and thereby maintains said gate in a closed position with said barrier, and a second, gate unlocking position that allows said gate to be decoupled from said gate latching medium, whereby said gate may be opened and provide access to said region, a first electronically operated lock that is configured to controllably move said locking member between said gate locking and unlocking positions when operated by an electronic key at a first port of said electronically operated gate locking mechanism, and a second electronically operated lock that is configured to controllably move said locking member between said gate locking and unlocking positions when operated by an electronic key at a second port of said electronically operated gate locking mechanism.

5. A method according to claim 4, wherein said gate latching medium comprises a closed loop of chain.

6. A method according to claim 4, wherein said electronically operated gate locking mechanism includes a controller which is operative to operate said first and second electronically operated locks, and to store said information representative of a history of electronic key operation thereof, and further including the step (c) of accessing said controller at either of said first and second ports.

7. A method according to claim 6, wherein said information representative of said history of electronic key operation of said electronically operated gate locking mechanism includes information associated with at least one of a user, date of use, and time of use of an electronic key engaging either of said first and second locks, and location of said electronically operated gate locking mechanism.

8. An electronic gate lock apparatus for locking a gate that provides access through a barrier comprising:

an electronically operated gate locking mechanism mountable with said barrier and engageable with a gate latching medium that secures said gate in a closed position with said barrier, and being lockable and unlockable by an electronic key at each of first and second sides of said barrier; and a data store coupled with said electronically operated gate locking mechanism and being operative to store information representative of a history of electronic key operation thereof from each of said first and second sides of said barrier.

9. An electronic gate lock apparatus according to claim 8, wherein said barrier comprises a fence having a fence post at a gate region thereof, and wherein said electronically operated gate locking mechanism is configured to be integrally mounted with said fence post.

10. An electronic gate lock apparatus according to claim 8, wherein said electronically operated gate locking mechanism is a stand-alone locking mechanism having a self-contained electrical power source.

11. An electronic gate lock apparatus according to claim 8, wherein said electronically operated gate locking mechanism includes:

a locking member moveable between a first, gate locking position that maintains said gate coupled with said gate latching medium and maintains said gate in a closed position with said barrier, and a second, gate unlocking position that allow s said gate to be decoupled from said gate latching medium, whereby said gate may be opened and provide access to said region, a first electronically operated lock that is configured to controllably move said locking member between said gate locking and unlocking positions when operated by an electronic key at a first port of said electronically operated gate locking mechanism, and a second electronically operated lock that is configured to controllably move said locking member between said gate locking and unlocking positions when operated by an electronic key at a second port of said electronically operated gate locking mechanism.

12. An electronic gate lock apparatus according to claim 11, wherein said data store is configured to be accessible from either of said first and second sides ports, and is operative to provide said information representative of said history of electronic key operation of said electronically operated gate locking mechanism.

13. An electronic gate lock apparatus according to claim 12, wherein said information representative of said history of electronic key operation of said electronically operated gate locking mechanism includes information associated with at least one of a user, date of use, and time of use of an electronic key engaging either of said first and second locks, and location of said electronically operated gate locking mechanism.

14. An electronic gate lock apparatus according to claim 8, wherein said electronically operated gate locking mechanism comprises a pair of mutually aligned, electronically actuated locks mounted to a deadbolt casing secured with said barrier, a gate lock bracket coupled with said deadbolt casing and cooperating with said deadbolt, when the deadbolt is rotated by the operation of either of said pair of electronically actuated locks, to secure said gate latching medium.

15. An electronic gate lock apparatus according to claim 14, further including a gate lock shroud coupled with said deadbolt casing.

16. An electronic gate lock apparatus according to claim 14, wherein said gate lock bracket comprises a fence, with which said deadbolt defines a gate-locking spatial configuration, when extended from said casing into a gate locking position in association with a locking condition of each of said electronically actuated locks.

17. An electronic gate lock apparatus according to claim 16, wherein said deadbolt is arranged to be withdrawn from said gate-locking spatial configuration with said fence, when retracted into a gate unlocking position in association with an unlocked condition of either of said electronically actuated locks.

18. A stand alone gate lock architecture that is adapted to be installed at a gate closure structure of a security barrier, comprising a mounting member that is affixable to said gate closure structure;

a common deadbolt casing secured to said mounting member and retaining therein a common deadbolt;

a dual lock mechanism configured to provide gate lock/unlock capability at both an interior side and an exterior side of said security barrier, said dual lock mechanism including an interior side locking mechanism supported by said mounting member at said interior side of said security barrier, so as to be operated by a key from said interior side of said gate closure structure, and engaging said common deadbolt, and an exterior side locking mechanism supported by said mounting member at said exterior side of said barrier, so as to be operated by said key from said exterior side of said gate closure structure, and engaging said common deadbolt;

a gate lock bracket affixed with said common deadbolt casing, and having a fence that is configured to receive a first portion of a closed loop of safety code-compliant latching medium, a second portion of said closed loop of safety code-compliant latching medium being retained at said security barrier, said fence being configured to form, with said common deadbolt, a secure closure for said closed loop of safety code-compliant latching medium, when said common deadbolt is rotated to a locking position by the operation of either of said interior side or exterior side locking mechanisms, whereby said closed loop of safety code-compliant latching medium maintains said gate in a closed position with said barrier and, when either of said interior side or exterior side locking mechanisms is unlocked, said common deadbolt is retracted away from said fence, so as to allow said closed loop of safety code-compliant latching medium to he lifted off and away from said fence, thereby permitting said gate to be displaced away from said security barrier.

19. A stand alone gate lock architecture according to claim 18, wherein said interior side and exterior side locking mechanisms are mounted to opposite sidewalls of said common deadbolt casing, and wherein said fence has a notch that is sized to receive said common deadbolt, and thereby form said secure closure for said closed loop of safety code-compliant latching medium when said common deadbolt is rotated to a locking position by the operation of either of said interior side or exterior side locking mechanisms.

20. A stand alone gate lock architecture according to claim 19, wherein said interior side locking mechanism comprises an interior side electronic locking mechanism that is controllably operated by a programmed electronic key therefore, and said exterior side locking mechanism comprises an exterior side electronic locking mechanism that is controllably operated by said programmed electronic key, and further including a battery-operated electronic lock control processor that is operative to control each of said interior side and exterior side electronic locking mechanisms, and store history data associated with each access by an electronic key so that all user access to said gate closure structure can be tracked.

* * * * *

UNITED STATES PATENT AND TRADEMARK OFFICE

CERTIFICATE OF CORRECTION

PATENT NO. : 6,277,019 B1
APPLICATION NO. : 09/303467
DATED : May 8, 2001
INVENTOR(S) : Kn Singh Chhatwal It is certified that error appears in the above-identified patent and that said Letters Patent is hereby corrected as shown below:

| | |
|---|---|
| Column 1, Line 40 | Delete: "airport's a perimeter"<br>Insert --airport's perimeter-- |
| Column 3, Line 20 | Delete: "as leave"<br>Insert --as to leave-- |
| Column 6, Line 65 | Delete: "allow s"<br>Insert: --allows-- |
| Column 7, Line 13 | Delete: "second sides ports,"<br>Insert --second side ports,-- |
| Column 8, Line 30 | Delete: "to he lifted"<br>Insert --to be lifted-- |

Signed and Sealed this

Second Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 6,227,019 B1
APPLICATION NO. : 09/303467
DATED : May 8, 2001
INVENTOR(S) : Kn Singh Chhatwal It is certified that error appears in the above-identified patent and that said Letters Patent is hereby corrected as shown below:

| | |
|---|---|
| Column 1, Line 40 | Delete: "airport's a perimeter"<br>Insert: --airport's perimeter-- |
| Column 3, Line 20 | Delete: "as leave"<br>Insert: --as to leave-- |
| Column 6, Line 65 | Delete: "allow s"<br>Insert: --allows-- |
| Column 7, Line 13 | Delete: "second sides ports,"<br>Insert: --second side ports,-- |
| Column 8, Line 30 | Delete: "to he lifted"<br>Insert: --to be lifted-- |

Signed and Sealed this

Twenty-seventh Day of March, 2007

JON W. DUDAS
*Director of the United States Patent and Trademark Office*